US007841491B2

(12) United States Patent
Contiero

(10) Patent No.: US 7,841,491 B2
(45) **Date of Patent: *Nov. 30, 2010**

(54) CLOSING SYSTEM FOR A CONTAINER, FOR EXAMPLE FOR TRIGGER DISPENSER

(75) Inventor: Paolo Contiero, Castellazzo Bormida (IT)

(73) Assignee: Guala Dispensing S.p.A., Alessandria (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/335,793

(22) Filed: Dec. 16, 2008

(65) Prior Publication Data

US 2009/0108030 A1 Apr. 30, 2009

Related U.S. Application Data

(63) Continuation of application No. 11/762,861, filed on Jun. 14, 2007.

(30) Foreign Application Priority Data

Apr. 18, 2007 (IT) ..... BS2007A0060

(51) Int. Cl.
*B67D 7/58* (2010.01)

(52) U.S. Cl. ..... 222/383.1; 222/153.01

(58) Field of Classification Search ..... 222/383.1, 222/153.09, 153.01, 340; 215/222, 224, 215/332, 252, 217–220, 223, 329–331, 316; 220/300, 296, 393, 288, 345.1, 345.2
See application file for complete search history.

(56) References Cited

U.S. PATENT DOCUMENTS 4,397,397 A * 8/1983 Herr ..... 215/211
5,551,582 A * 9/1996 Robinson ..... 215/216
5,725,132 A 3/1998 Foster et al.
5,779,072 A * 7/1998 Krebs ..... 215/219
5,810,209 A * 9/1998 Foster ..... 222/383.1
5,845,820 A * 12/1998 Foster ..... 222/383.1
5,913,434 A * 6/1999 Fukuhara et al. ..... 215/44
5,928,594 A * 7/1999 Foster ..... 264/255
5,938,082 A * 8/1999 Foster et al. ..... 222/153.09
6,138,873 A * 10/2000 Gramola ..... 222/153.14

(Continued)

FOREIGN PATENT DOCUMENTS

EP 0 208 390 A1 1/1987

(Continued)

OTHER PUBLICATIONS

Standard Search Report for Italian Patent Application No. IT BS20070060 dated May 16, 2007.

*Primary Examiner*—Kevin P Shaver
*Assistant Examiner*—Robert K Nichols, II
(74) *Attorney, Agent, or Firm*—Kilyk & Bowersox P.L.L.C.

(57) ABSTRACT

The present invention relates to a closing system for a container, having a neck of the container and a closing body. The body wall includes at least one flexible tongue and at least one relatively stiff protrusion that, when the tongue is seated in the seating portion, arranges circumferentially sided to a circumferential stopping projection of the neck. In an imminent interference configuration, reached by relative rotation between the neck and the closing body, the protrusion interferes with the circumferential stopping projection for making an obstacle to the further rotation in the same direction of rotation, while the tongue is free from interferences with further obstacles to rotation.

17 Claims, 7 Drawing Sheets

U.S. PATENT DOCUMENTS

| | | | | |
|---|---|---|---|---|
| 6,155,462 | A * | 12/2000 | Brecheisen et al. | 222/153.09 |
| 7,478,739 | B2 * | 1/2009 | Foster | 222/383.1 |
| 2004/0074928 | A1 * | 4/2004 | Maas et al. | 222/383.1 |
| 2004/0245204 | A1 * | 12/2004 | Suffa | 215/224 |
| 2008/0257913 | A1 | 10/2008 | Contiero | |

FOREIGN PATENT DOCUMENTS

| | | | |
|---|---|---|---|
| EP | 0 867 230 | A2 | 9/1998 |
| WO | WO 94/13547 | * | 6/1994 |

* cited by examiner

CLOSING SYSTEM FOR A CONTAINER, FOR EXAMPLE FOR TRIGGER DISPENSER

This application is a continuation of U.S. patent application Ser. No. 11/762,861 filed Jun. 14, 2007, which in turn claims the benefit of earlier filed Italian Patent Application No. BS2007A000060 filed Apr. 18, 2007.

BACKGROUND OF THE INVENTION

1. Field of the Invention

The present invention relates to a closing system for the coupling between a container and a closing body, suitable for closing the container.

In particular, the present invention relates to a closing system between a container for a liquid and a pump body, which when coupled make a pump dispenser suitable for dispensing the liquid, for example a trigger dispenser.

2. Description of the Prior Art

There exist several closing systems between a container, generally shaped as a bottle, and a closing body, both in the field of containers in general, wherein the closing body is a cap, and in the specific field of dispensers.

In general, closing systems are by screwing, that is, such as to envisage a threading on the container neck and on the closing body, or bayonet-wise.

Bayonet closing systems have proved to be particularly useful in the field of dispensers, for technological manufacturing reasons, for usage convenience reasons and for the adaptability to the solution of particular design problems (CRC—Child Resistant Containers, for children safety, and the like).

Several embodiments of bayonet closing systems are known.

However, bayonet systems known to date have shown some disadvantages of wear of the parts that in the coupling and separation of the container from the closing body, structurally interfere with each other.

SUMMARY OF THE INVENTION

The object of the present invention is to make a bayonet closing system for the coupling of a container with a closing body which should overcome the disadvantages mentioned above with reference to the prior art.

Such object is achieved by a closing system for a container comprising:

a neck of the container, comprising an annular neck wall which develops about a main axis and delimits an opening to access inside the container, wherein the neck wall comprises:

a) at least a first axial stopping projection, protruding from the neck wall;

b) at least a first circumferential stopping projection, protruding from the neck wall;

c) a seating portion, axially sided to the first axial stopping projection;

a closing body comprising an annular body wall suitable for removably coupling with the neck wall, wherein the body wall comprises a) at least one tongue projecting from the body wall suitable for axially interfering snap-wise with the axial stopping projection, thus arranging in the seating portion;

wherein the closing wall comprises at least one protrusion that, when the tongue is seated in the seating portion, arranges circumferentially sided to the circumferential stopping projection;

and wherein the stopping projections and the tongue are sized and arranged so that in an imminent interference configuration, reached by relative rotation between the neck and the closing body according to a separating rotation direction, the protrusion interferes with the circumferential stopping projection for making an obstacle to the further rotation in the same direction of rotation, whereas the tongue is free from interferences with further obstacles to rotation.

BRIEF DESCRIPTION OF THE DRAWINGS

The features and advantages of the closing system according to the present invention will appear more clearly from the following description, made by way of an indicative and non-limiting example with reference to the following figures, wherein.

DESCRIPTION OF THE PREFERRED EMBODIMENTS

Figure 1:
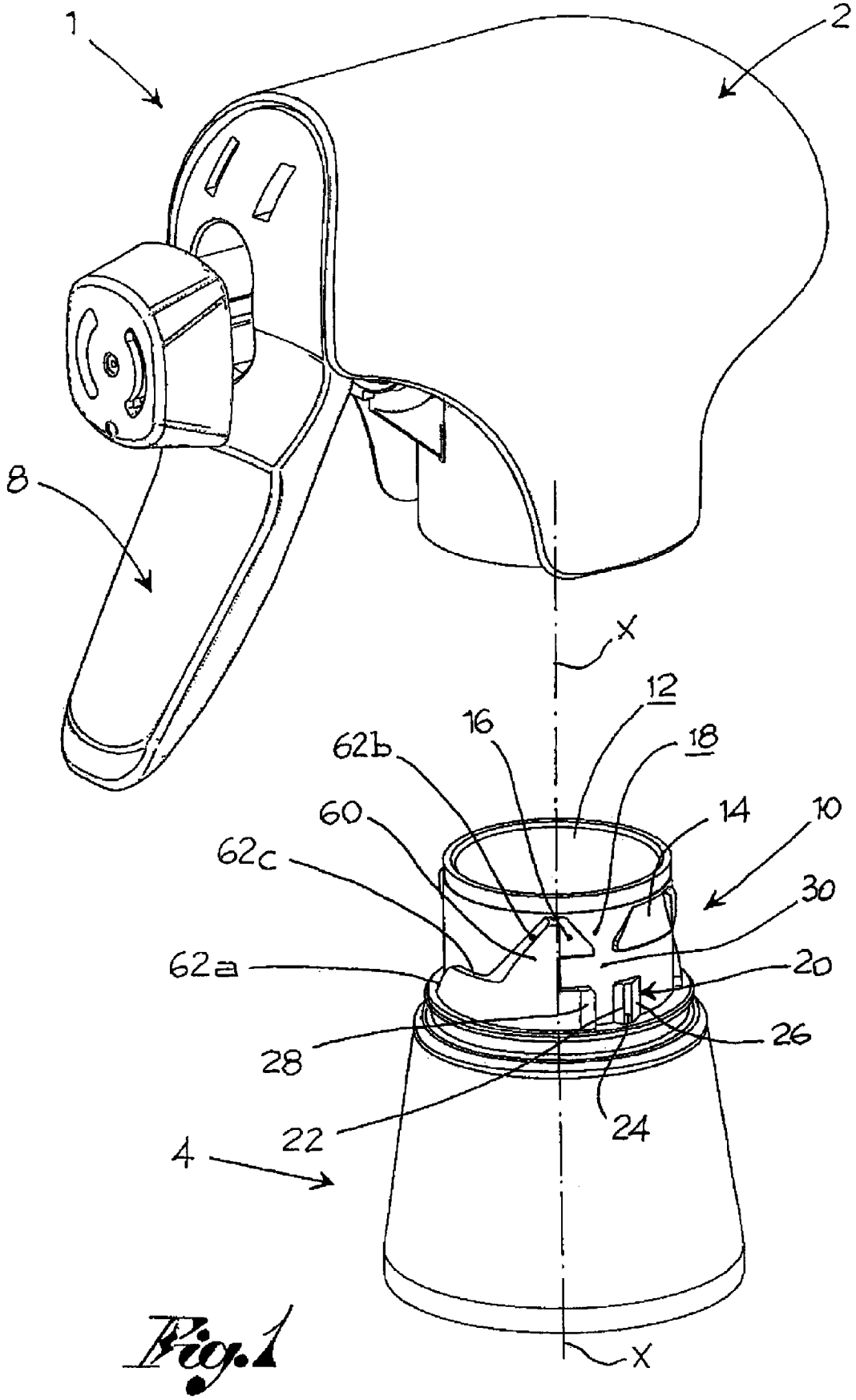
FIG. 1 shows a perspective exploded view of a dispenser comprising a container and a pump body.
Figure 2:
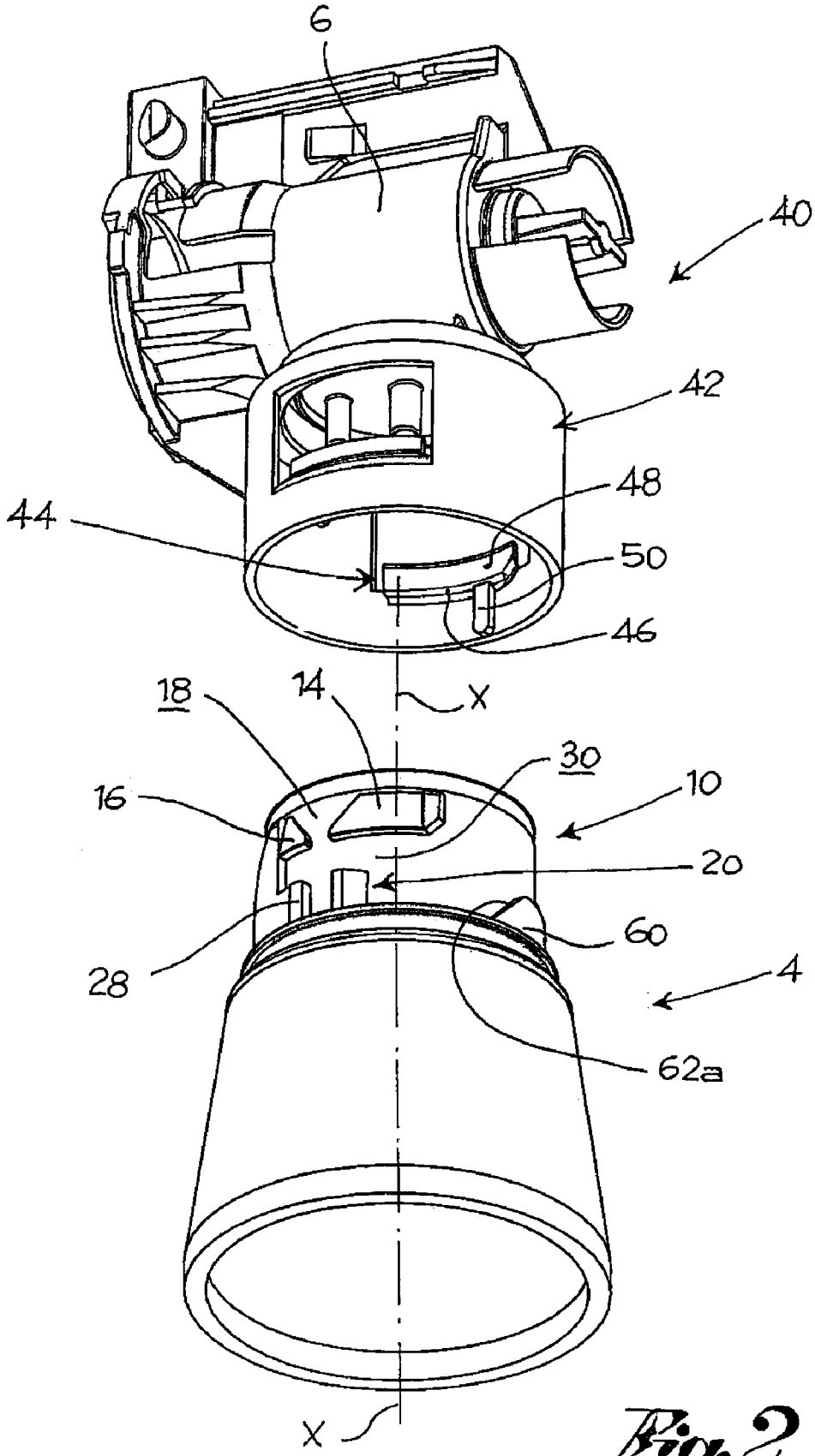
FIG. 2 shows a perspective exploded view of a main body of the pump body and of the dispenser according to a first viewing direction.
Figure 3:
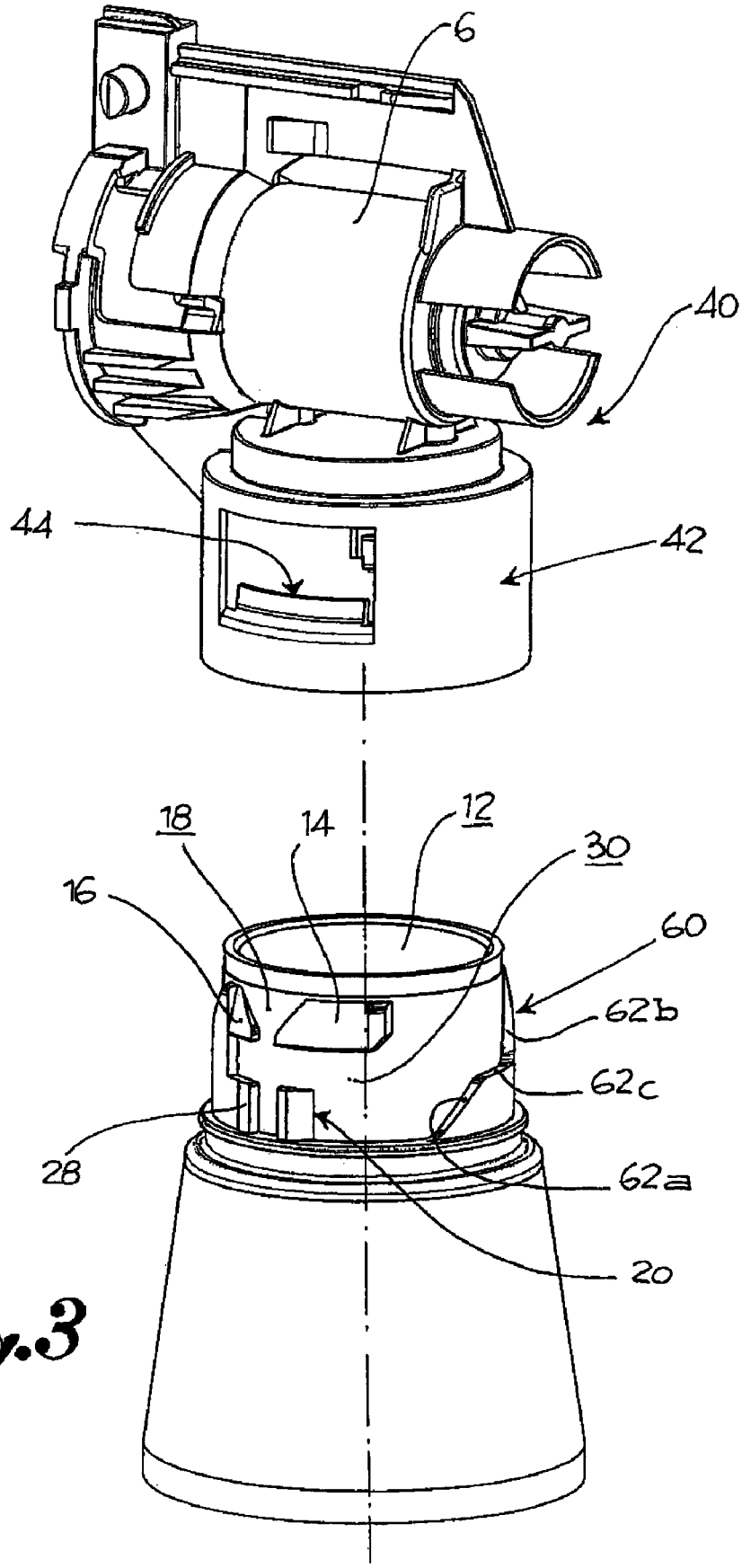
FIG. 3 shows the main body and the container of FIG. 2 according to a further viewing direction.
Figure 4:
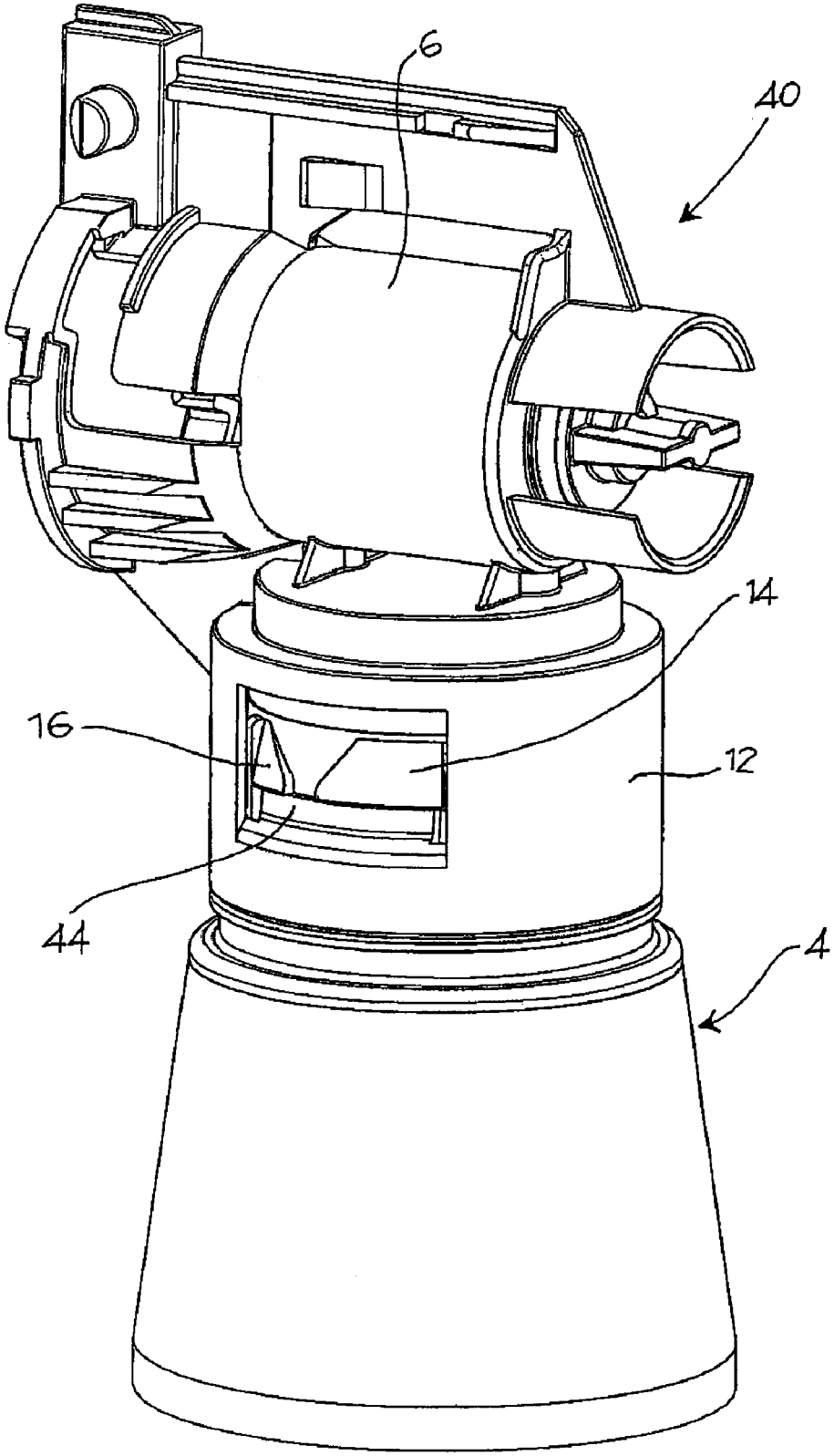
FIG. 4 shows the main body and the container of FIGS. 2 and 3 with coupled parts.
Figure 5:
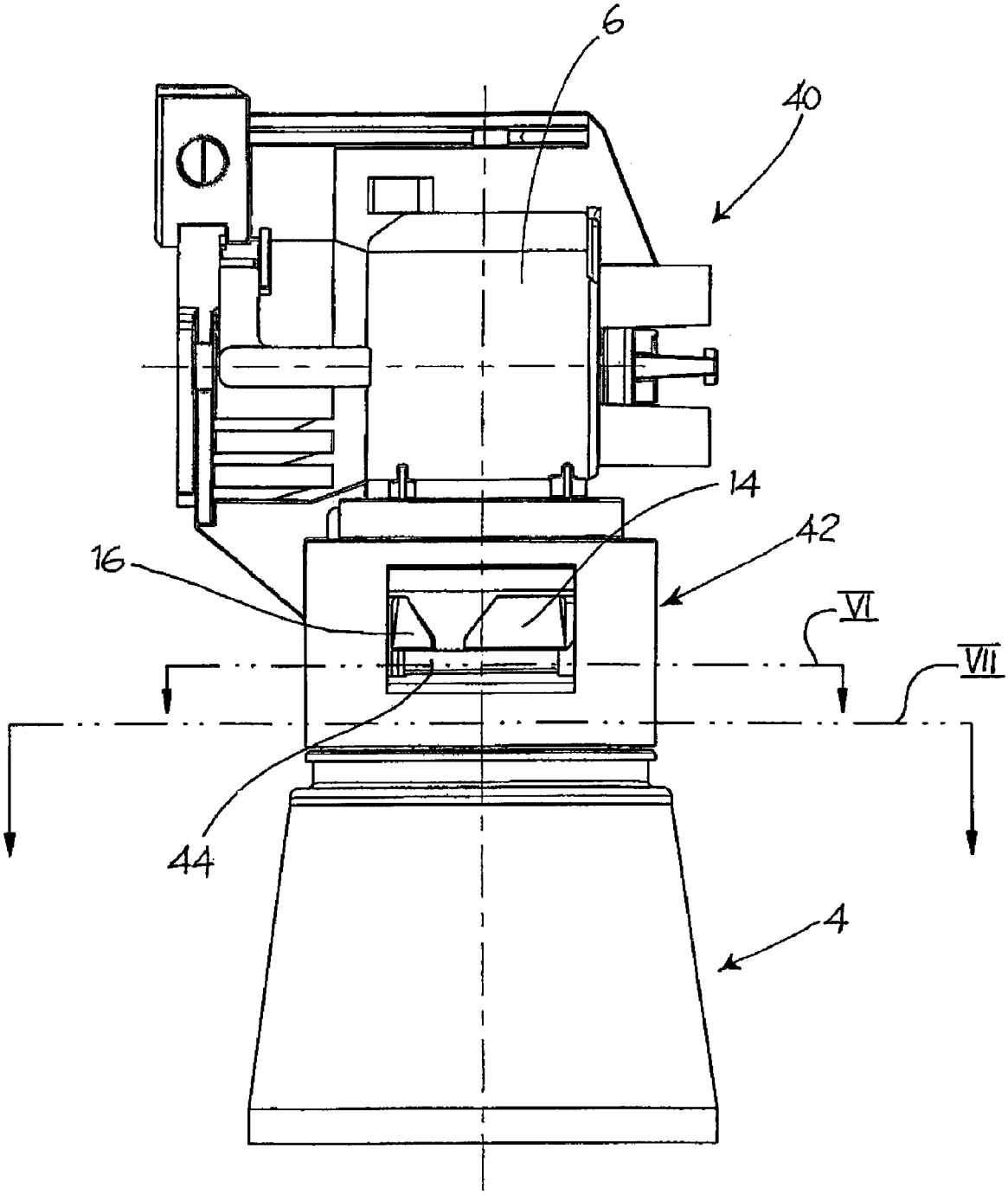
FIG. 5 shows a side view of the main body and of the container of FIG. 4.
Figure 6:
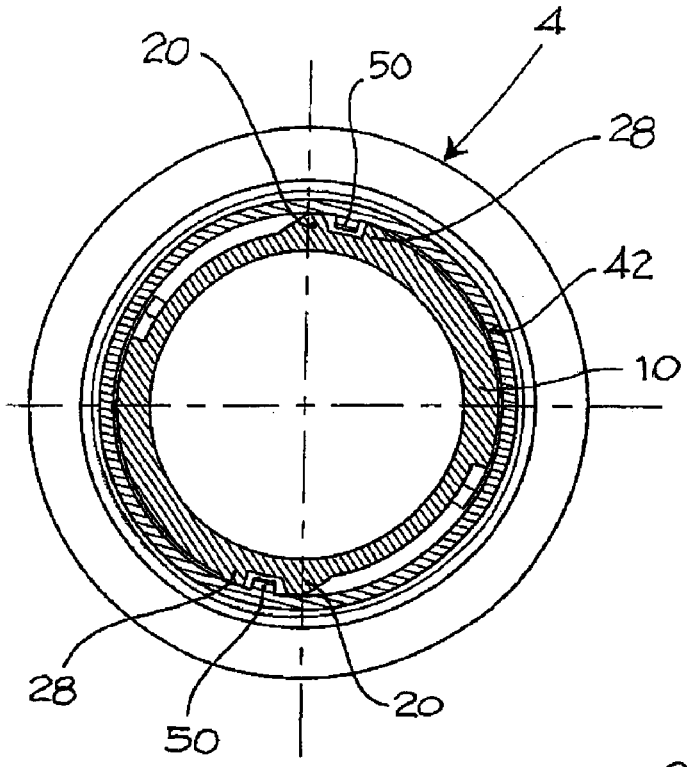
FIG. 6 shows a section view of the main body and of the container coupled to each other, obtained according to section line VI of FIG. 5.
Figure 7:
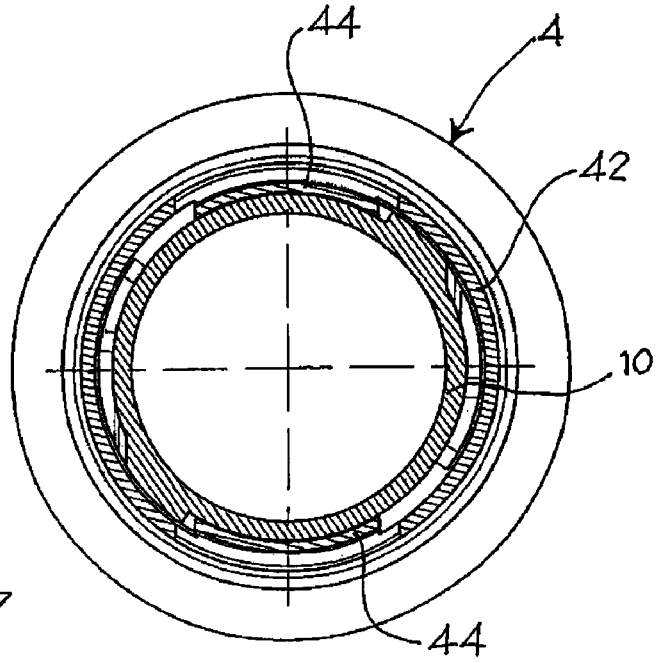
FIG. 7 shows a section view of the main body and of the container coupled to each other, obtained according to section line VII of FIG. 5.

For clarity of description, explicit reference shall be made hereinafter to a trigger dispenser; however, the present invention is applicable also to an assembly comprising a container and a cap.

In accordance with FIGS. 1 to 7, reference numeral 1 globally indicates a trigger dispenser, comprising a pump body 2 and a container, ending with a neck 4.

The pump body 2 is suitable for being coupled to the container in a removable manner, for example for allowing filling or emptying the liquid contained in the container.

Suction means are housed inside pump body 2 suitable for sucking the liquid from the container and feeding it to a pumping chamber 6, pumping means actuated by a trigger 8 and suitable for influencing the liquid residing into the pumping chamber 6 and ejecting it therefrom, and dispensing means connected to the pumping chamber 6 and suitable for receiving the liquid ejected therefrom and for dispensing it outside the dispenser.

Neck 4 comprises an annular neck wall 10 which extends about a main axis X-X, between a bottom facing the container, and a top where it delimits an opening 12 to access inside the container.

The annular neck wall 10 comprises at least a first axial stopping projection 14, protruding from the neck wall 10, for example outwards thereof.

According to a preferred embodiment, the first axial stopping projection 14 exhibits an axially variable thickness, for example in a linear manner, that is, defining a substantially flat surface.

In particular, the thickness increases from the top to the bottom of the neck.

According to a preferred embodiment, neck 4 comprises a second axial stopping projection 16, separated from the first one 14 and circumferentially spaced therefrom.

Also the second axial stopping projection 16 preferably exhibits a thickness that increases from the top of the neck to the bottom.

Preferably, moreover, the circumferential extension of the first axial stopping projection 14 is greater than the circumferential extension of the second axial stopping projection 16.

Between the first 14 and the second axial stopping projection 16 that is an inlet duct 18 that preferably exhibits a funnel shape converging towards the neck bottom.

Moreover, the closing system comprises at least a first circumferential stopping projection 20, protruding from the neck wall 10, for example externally.

Preferably, the first circumferential stopping projection 20 exhibits a rising ramp 22, a flat portion 24, jointed to the rising ramp 22, and a falling ramp 26, opposite the rising ramp 22, jointed to the flat portion 24.

According to a preferred embodiment, neck 4 comprises a second circumferential stopping projection 28, circumferentially spaced from the first circumferential stopping projection 20.

Moreover, the closing system comprises a seating portion 30, axially sided to the first axial stopping projection 14.

In other words, for example, below the first axial stopping projection 14 there is an outer surface portion of the neck wall 10, axially delimited between the first axial stopping projection 14 and the first circumferential stopping projection 20; the surface makes the seating portion 30, free from projections or protrusions.

The inlet duct 18 communicates with the seating portion 30 and the latter communicates with the space between the circumferential stopping projections 20, 28, without any obstacles in the passage sections from the one to the other.

Moreover, the closing system comprises a closing body 40; for example, in the embodiment shown, the closing body 40 is seated in the pump body 2 and the pumping chamber 6 is obtained therein.

The closing body 40 comprises an annular body wall 42 suitable for removably coupling with the neck wall 10.

The closing body 40 comprises at least one tongue 44 projecting from the body wall 42, for example internally, suitable for axially interfering snap-wise with the first axial stopping projection 14, thus arranging in the seating portion 30.

According to a preferred embodiment, the closing body comprises two tongues, for example arranged diametrically opposite.

Preferably, moreover, tongue 44 comprises a jointing portion 46, directly jointed to the body wall 42, and an active portion 48, jointed to the jointing portion 46, but separated from the body wall 42.

According to an embodiment variation, tongue 44 is sized for concurrently sliding in contact with the first 14 and the second axial stopping projection 16, for inserting in the seating portion 30. Moreover, the closing body 40 comprises at least one protrusion 50 that, once tongue 44 is seated in the seating portion 30, arranges circumferentially sided to the first circumferential stopping projection 20.

Preferably, protrusion 50 is arranged below tongue 44, that is, proximal to the edge of the wall body 42 relative to tongue 44.

The first stopping projections 14, 20, tongue 44 and protrusion 50 are sized and arranged so that in an imminent interference configuration, reached by relative rotation between neck 4 and the closing body 40 according to a separating rotation direction, protrusion 50 interferes with the first circumferential stopping projection 20 for making an obstacle to the further rotation in the same direction of rotation, whereas the tongue is free from interferences with further obstacles to rotation.

In other words, once the closing body 40 is coupled to neck 4 of the container, protrusion 50 arranges between the first 20 and the second circumferential stopping projection 28, whereas tongue 44 arranges on the seating portion 30; by rotating the closing body in a separating rotation direction (for example in counter clockwise direction in FIG. 2), protrusion 50 interferes with the first circumferential stopping projection 20, whereas tongue 44 slides on the surface of portion 30 without meeting any obstacles.

Protrusion 50 therefore makes an anti-rotation stop. According to a preferred embodiment, the seating portion 30 is circumferentially delimited in the separating rotation direction, by a cam wall 60, shaped for guiding protrusion 50 towards the container opening, so as to make a relative axial sliding between neck 4 and the closing body 40 subsequent to the relative rotation.

For example, the cam wall 60 comprises a first ramp surface 62*a* that develops from the neck bottom to the top thereof, reaching up to half the height thereof.

Preferably, moreover, the cam wall 60 comprises a second ramp surface 62*b*, jointed to the first, which develops up to reaching the proximity of the edge delimiting the opening.

Preferably, the first and the second ramp surface 62*a*, 62*b* are jointed by a jointing surface 62*c*, substantially horizontal, that is, laying on a plane perpendicular to axis X-X.

In particular, the cam wall 60 is positioned and sized so that tongue 44 of the closing body 40, during the relative rotation with neck 4, does not contact the cam wall 60.

In other words, during the relative rotation, protrusion 50 slides on the ramp surfaces of wall 60, making a relative axial shifting between the neck and the closing body and keeping tongue 44 spaced from the cam wall 60.

Figure 8:
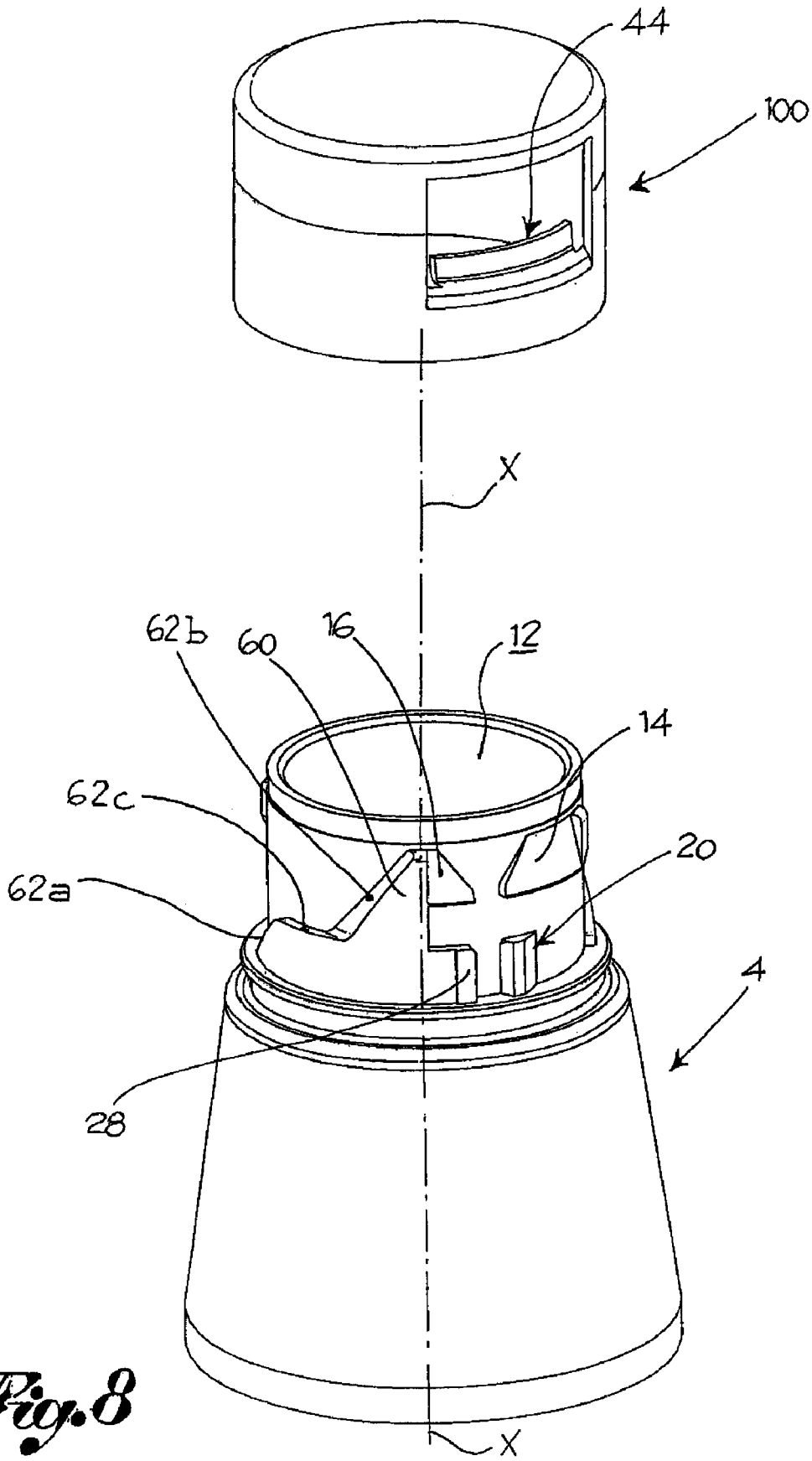
FIG. 8 shows an exploded view of a container and of the relevant cap.

According to the embodiment of FIG. 8, the assembly comprises the container, provided with neck 4 and with the structural features described above, and a closing body 100, shaped as a cap, provided with the structural features described above.

In the assembly of the dispenser, the closing body 40 is made to axially shift towards the container neck.

Protrusion 50 progressively inserts in the inlet duct 18, guided by the peculiar shape thereof and, continuing the shifting of the closing body, arranges between the circumferential stopping projections.

At the same time, tongue 44 slides on the axial stopping projections, deforming and finally snapping on the seating portion 30.

In the assembled configuration (FIG. 4), the closing body 40 is axially constrained to the container neck, since tongues 44 oppose a relative axial shifting, abutting against the axial stopping projections 14, 16.

In order to separate the closing body 40 from the container neck 4, a more or less strong rotation of the closing body relative to the neck is sufficient.

Such rotation, for example counter clockwise in the annexed figures, leads protrusion 50 to interfere with the first circumferential stopping projection 20.

By suitably forcing the rotation, protrusion 50 goes along the rising ramp 22 of the first circumferential stopping projection 20 and past it. During the condition of interference of protrusion 50 with the circumferential stopping projection 20, tongue 44 is free to slide on the surface of the seating portion 30, without any obstacles.

When protrusion 50 has passed beyond the first circumferential stopping projection 20, continuing the rotation, protrusion 50 is guided towards the neck top by the cam wall 60, thus making a relative axial shifting between the closing body 40 and neck 4 that leads to the separation thereof. Innovatively, the closing system described above allows obtaining a bayonet closure that exhibits high reliability, since the most deformable and thus weakest portions, for example the tongues, during the rotation for separating the portions must not be forced on projections or protrusions.

In the case of a dispenser, a further advantageous aspect consists in easily replacing an empty container with a new container filled with liquid; in that case, in fact, the projections allow properly positioning the pump body relative to the neck of the new container, preventing the user from wrongly arranging the tongues by wrongly screwing the pump body to the neck of the new container, with the risk that the container could accidentally separate from the pump body.

Advantageously, moreover, the closing system allows automatically correcting slight angular misalignment between the closing body and the neck during the step of reciprocal axial approach of the parts in assembly, thanks to the peculiar shape of the inlet duct.

According to a further advantageous aspect, assembly takes place in a soft manner, since the portions intended for deforming, that is, the tongues, are highly flexible, thanks to the projecting shape relative to the wall.

It is clear that a man skilled in the art can make several changes and variations to the closing system described above in order to meet specific and incidental needs.

For example, the closing body 40 comprises three or more tongues, for example equally spaced angularly.

Also such variations are to be regarded as falling within the scope of protection as defined by the following claims.

The invention claimed is:

1. A trigger dispenser comprising: —a container; —a pump body suitable for being coupled to the container, wherein a suction means, a pumping means, and a dispensing means are seated therein, wherein: the suction means is suitable for sucking the liquid from the container and feeding it to a pumping chamber; the pumping means is actuated by a trigger suitable for influencing the liquid residing into the pumping chamber and ejecting it therefrom; and the dispensing means is connected to the pumping chamber and suitable for receiving the liquid ejected therefrom and dispensing it outside the dispenser; —a closing system comprising:

a neck of the container, comprising an annular neck wall which develops about a main axis and delimits an opening to access inside the container, wherein the neck wall comprises:

a) at least a first axial stopping projection, externally projecting from the neck wall;

b) at least a first circumferential stopping projection, externally projecting from the neck wall;

c) a seating portion, axially sided to the first axial stopping projection; and wherein the neck further comprises (i) a second circumferential stopping projection, separated from the first circumferential stopping projection and circumferentially spaced therefrom, or (ii) a second axial stopping projection, separated from the first axial stopping projection and circumferentially spaced therefrom, or both (i) and (ii);

a closing body comprising:

a) an annular body wall;

b) at least one flexible tongue, internally projecting from the body wall, wherein the tongue is suitable for axially interfering snap-wise with the first axial stopping projection, thus arranging in the seating portion;

c) at least one protrusion, more rigid than the tongue and axially spaced from the tongue, that, when the tongue is seated in the seating portion, arranges circumferentially sided to the first circumferential stopping projection; wherein said at least one protrusion is arranged below said tongue such that the protrusion is proximal to the edge of the annular body wall.

2. A system according to claim 1, wherein the neck further comprises the second circumferential stopping projection, wherein when the tongue is seated in the seating portion, the protrusion is arranged between the first and second circumferential stopping projections.

3. A system according to claim 1, wherein the seating portion exhibits a sliding surface free from projections.

4. A system according to claim 1, wherein the first axial stopping projection exhibits a thickness that increases from the top of the neck to the bottom.

5. A system according to claim 1, wherein the closing body comprises two tongues.

6. A system according to claim 1, wherein the closing body comprises two protrusions.

7. A system according to claim 6, wherein the protrusions are in one piece with the body wall.

8. A system according to claim 6, wherein the protrusions are diametrally opposed.

9. A system according to claim 1, wherein said protrusion provides an anti-rotation stop.

10. A system according to claim 1, wherein said protrusion interferes with the first circumferential stopping projection.

11. A system according to claim 1, wherein said seating portion is circumferentially delimited in a separating rotation direction.

12. The trigger dispenser of claim 1, wherein said container has a neck, and the closing body is axially contained to the neck of the container.

13. A system according to claim 1, wherein the protrusion is in one piece with the body wall.

14. A system according to claim 1, wherein the tongue and the protrusion are circumferentially spaced.

15. A system according to claim 1, wherein the closing body comprises three or more tongues.

16. A system according to claim 15, wherein the tongues are equally spaced angularly.

17. A system according to claim 1, wherein the neck further comprises the second axial stopping projection, and further comprises an inlet duct between the second axial stopping projection and the first axial stopping projection, wherein the inlet duct exhibiting a funnel shape converging towards a neck bottom.

* * * * *